United States Patent [19]

Golden

[11] 4,017,931

[45] Apr. 19, 1977

[54] LIQUID FILLED INSOLES

[75] Inventor: Preston L. Golden, Miami Beach, Fla.

[73] Assignee: The Jonathan-Alan Corporation, Miami Beach, Fla.

[22] Filed: May 20, 1976

[21] Appl. No.: 688,299

[52] U.S. Cl. ..... 12/146 B; 36/44

[51] Int. Cl.[2] ..... A43D ; A43D 29/00

[58] Field of Search ..... 12/146 B; 36/29, 30, 36/44, 71

[56] References Cited

UNITED STATES PATENTS

| | | | |
|---|---|---|---|
| 1,517,171 | 11/1924 | Rosenwasser | 36/29 |
| 2,477,588 | 8/1949 | Dumm | 36/44 X |
| 2,549,343 | 4/1951 | Stoiner | 36/29 |
| 3,063,076 | 11/1962 | Williams | 12/146 B |
| 3,418,732 | 12/1968 | Marshack | 12/146 B |
| 3,724,106 | 4/1973 | Magidson | 36/44 |
| 3,922,801 | 12/1975 | Zente | 36/44 |

*Primary Examiner*—Alfred R. Guest
*Attorney, Agent, or Firm*—Stoll and Stoll

[57] ABSTRACT

A hollow insole provided with non-communicating compartments which are filled with liquid to form individual foot-supporting cushions. Included in the invention is a method of making the insole.

2 Claims, 13 Drawing Figures

LIQUID FILLED INSOLES

BACKGROUND OF THE INVENTION

1. Field of the Invention

This invention relates to cushioned insoles for shoes and other footwear. Such cushions are worn for orthopedic purposes or simply for comfort.

2. Prior Art

The closest prior art known to applicant is Zente U.S. Pat. No. 3,922,801 issued Dec. 2, 1975. Additional prior art is cited in the Zente Patent, namely: Pat. Nos. 532,429, 1,069,001, 1,193,608, 1,148,376, 1,517,171, 2,477,588, 2,546,296, 2,549,343, 2,641,066 and 3,724,106.

The Zente Patent shows a plurality of non-communicating compartments formed between a pair of plastic laminae, each of said compartments containing a separate liquid-filled ampule or bag. In the illustrated form of the Zente insole there are eleven compartments and eleven liquid-filled ampules confined within said compartments.

The procedure for making the Zente insole is complicated and costly and the result is less than optimum since the desired cushion effect is diminished by the presence of multiple plastic layers between the liquid and the foot.

SUMMARY OF THE INVENTION

The liquid-filled insole of the present invention defines a liquid-tight, liquid-filled envelope comprising only three elements: a pair of superposed plastic sheets secured to each other peripherally and in an internal functional design or pattern to form a plurality of non-communicating compartments between them, and a liquid occupying the compartments. The sheets are made of relatively flexible, strong thermoplastic material commonly known as vinyl or poly-vinyl-chloride. Other flexible, strong, thermoplastic sheets or films may be used to equal advantage. The liquid used is simply water or any other liquid which is chemically inert with respect to the plastic envelope. Examples of suitable liquid materials are set forth in the Zente Patent.

In the making of applicant's insole, the liquid is poured before the compartments are formed. Specifically, the following steps are taken:

a. A first vinyl sheet is treated with heat and pressure to produce a dish-shaped form.

b. A liquid, e.g., water, is poured into the dish-shaped vinyl form.

c. A second vinyl sheet is superimposed upon the water-filled, dish-shaped vinyl form and they are pressed together to displace the air between them. The two vinyl sheets are now sealed together by heat and pressure, along their peripheral edges to form a closed, water-filled, air-evacuated envelope.

d. The sealed envelope is then again sealed together, by heat and pressure, but this time in accordance with a functional design or pattern which defines a plurality of non-communicating, liquid-filled compartments. A second peripheral seal may also be formed in this operation.

DESCRIPTION OF INVENTION

Figure 1:
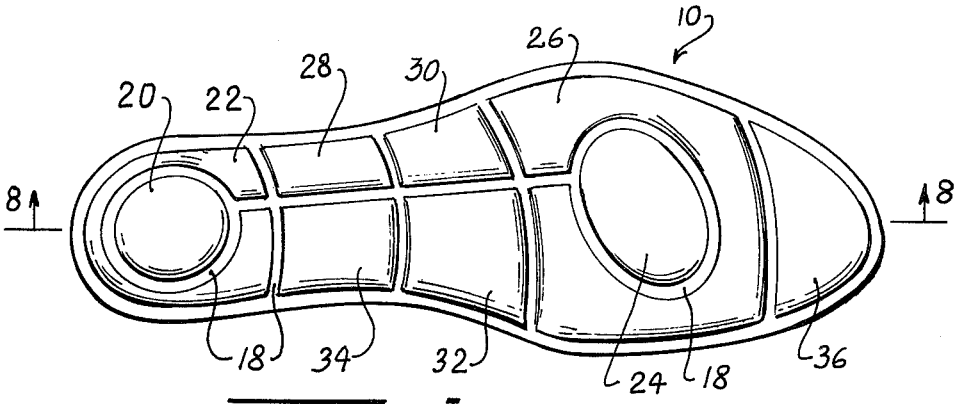
FIG. 1 is a plan view of a liquid-filled insole made in accordance with this invention.
Figure 3:
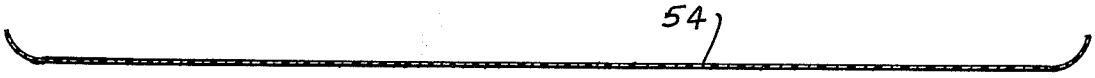
FIG. 3 is a longitudinal section on the line 3—3 of FIG. 2, showing the aforementioned dish shape of the bottom sheet of the insole.

As above indicated, insole 10 made in accordance with this invention, comprises a bottom sheet 12, a top sheet 14 superimposed thereon and secured thereto, and a liquid 16 between the two sheets. As will be seen in FIG. 1, in plan view insole 10 has the conventional shape of an insole to fit into a conventional shoe.

More specifically, insole 10 is divided by heat sealed partitions 18 into a plurality of non-communicating pockets or compartments which contain the liquid. These partitions follow an orthopedically functional design or pattern (shown in FIG. 1) which arranges the compartments in accordance with the anatomical requirements of a human foot. Thus, oval compartment 20 and surrounding compartment 22 support the heel of the foot, oval compartment 24 and surrounding compartment 26 support the ball of the foot, quadrilateral compartments 28, 30, 32 and 34 support the arch, and crescent-shaped compartment 36 supports the toes.

These liquid-filled compartments are formed when the top and bottom sheets are heat sealed to each other both peripherally and in accordance with the functional design or pattern above described. The spaces between the peripheral seal and partitions 18, as well as within said partitions, define the liquid-filled compartments.

Figure 5:
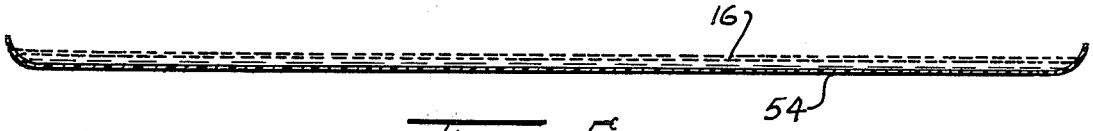
FIG. 5 is a longitudinal section on the line 5—5 of FIG. 4.
Figure 7:
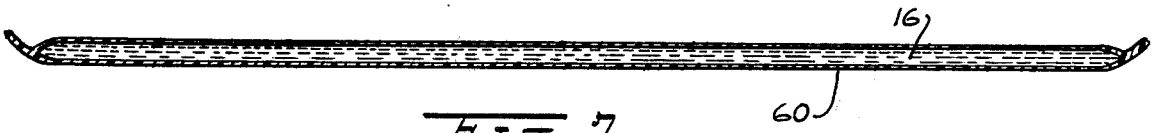
FIG. 7 is a longitudinal section on the line 7—7 of FIG. 6.
Figure 8:
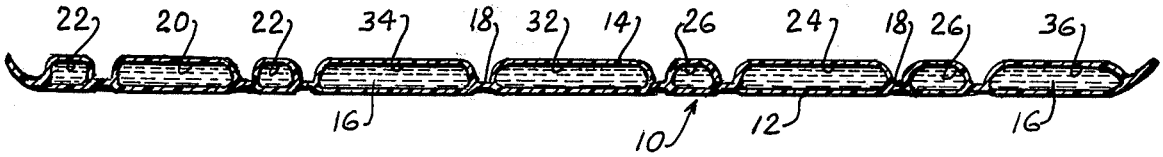
FIG. 8 is a longitudinal section on the line 8—8 of FIG. 1, showing the structure of the insole following the formation of individual, liquid-filled compartments in the structure of FIG. 6.
Figure 2:
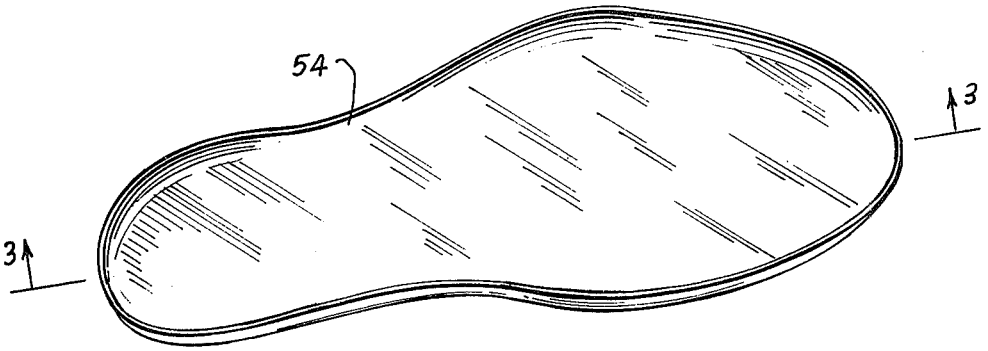
FIG. 2 is a perspective view of the bottom sheet of the insole following the initial step in the process of making the insole, said step being the formation of a dish-shaped element adapted to contain a liquid.
Figure 4:
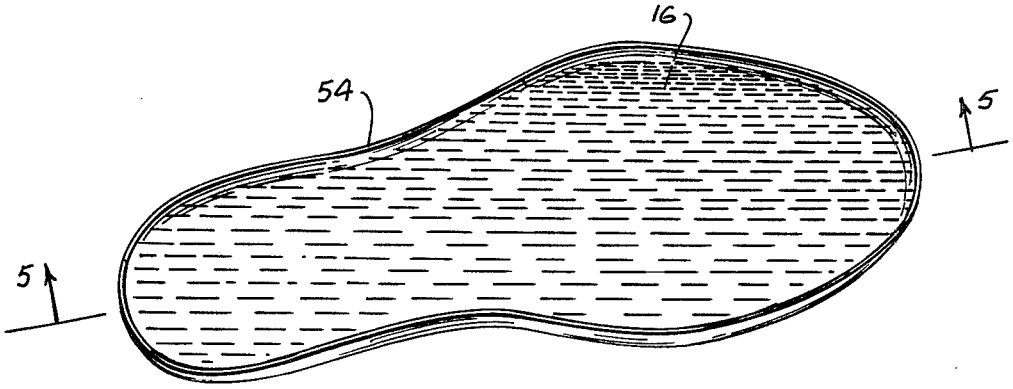
FIG. 4 is a view similar to that of FIG. 2, but showing the dish-shaped bottom sheet containing a liquid, this being the result of the second step in the process of making the present insole.
Figure 6:
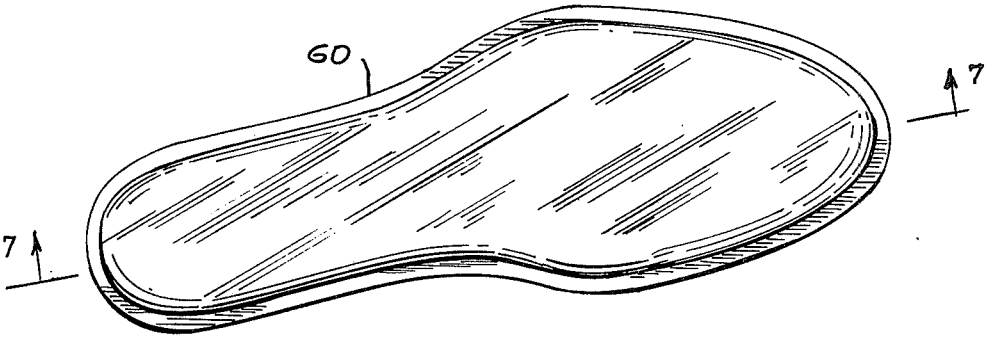
FIG. 6 is another perspective view, showing the top layer of the insole superimposed upon, and secured peripherally to, the liquid-filled bottom sheet shown in FIG. 4.
Figure 9:
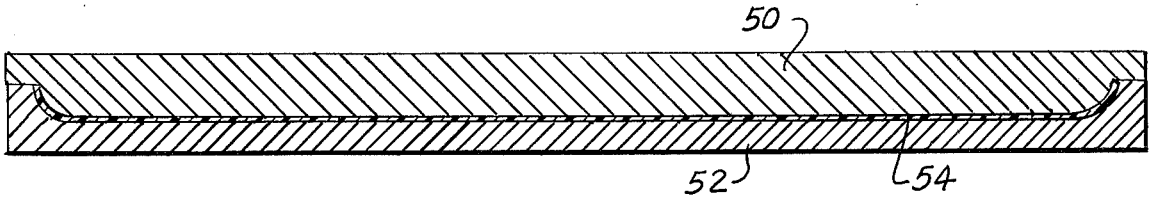
FIG. 9 is a schematic view in longitudinal section, showing the lower sheet of the insole in a die which heat-forms it into a dish-shaped element.
Figure 10:
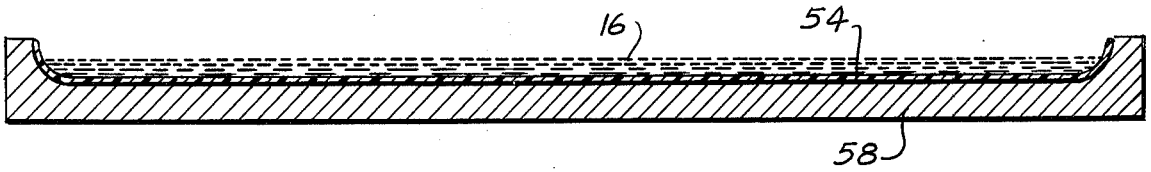
FIG. 10 is another schematic view in longitudinal section, showing the dish-shaped lower sheet in a die which heat-seals the peripheral edges of the two sheets, said lower sheet being shown filled with a liquid.
Figure 11:
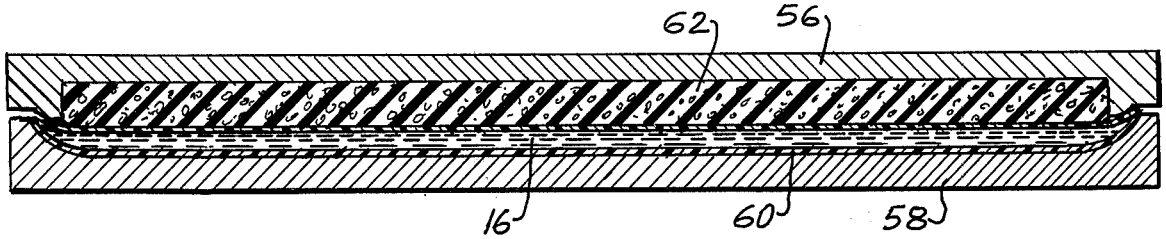
FIG. 11 is still another schematic view in longitudinal section, showing the two sheets in said periphery-sealing die prior to the sealing operation.
Figure 12:
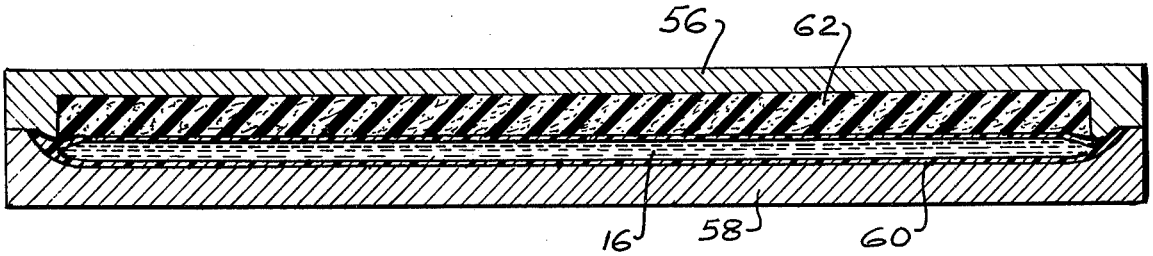
FIG. 12 is a view, similar to that of FIG. 11, but showing the two sheets heat-sealed peripherally to each other.
Figure 13:
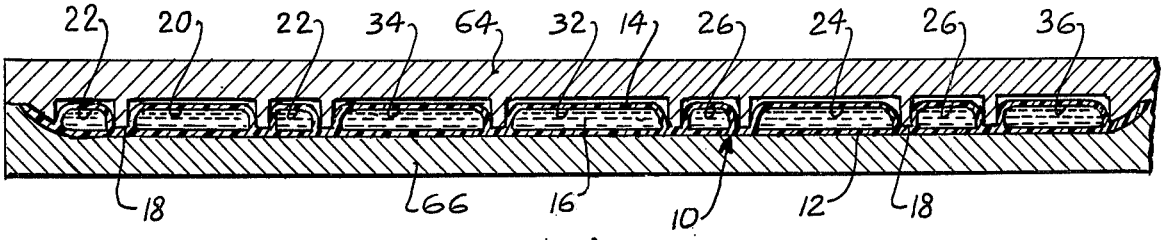
FIG. 13 is a schematic view in longitudinal section, showing the insole in a die which forms the individual compartments in the insole.

The specific steps in the making of the insole herein claimed may be set forth as follows:

a. A first (bottom) vinyl sheet (or other thermoplastic sheet or film) is subjected to heat and pressure between die elements or platens 50, 52 and a dish-shaped element 54 is thereby formed. See Figure.

b. A liquid 16, e.g., water, is poured into dish-shaped element 54. See FIG. 5.

c. A second (top) vinyl sheet is placed upon the liquid-containing element 54 and they are both placed between die elements 56,58 which heat-seals them together along their peripheral edges, thereby forming a liquid-tight, liquid-filled envelope 60. However, before this heat sealing operation takes place, it is necessary to remove the air from between the two vinyl elements. This is accomplished by means of a foam pad 62 which underlies die element 56. This pad presses the second (top) vinyl sheet against the liquid in the first (bottom) vinyl sheet and thereby displaces the air from between the two sheets. The heat-sealing operation thereupon takes place. See FIGS. 11 and 12.

d. In the final step, the heat-sealed envelope 60 is placed between heat sealing dies 64, 66 where the final configuration of the insole is produced. Die 64 has the configuration of the design or pattern which is to be impressed on the insole and it heat seals the upper and lower vinyl sheets to each other in accordance with said design or pattern. These dies 64, 66 may also reinforce the peripheral seal between the sheets. The result of this operation is a multi-compartmented, liquid-filled insole 10 as depicted in FIGS. 1 and 8. See also FIG. 13.

It will be understood that conventional heat-sealing dies may be used for the purposes of this invention, for example, the electronic (high frequency) heat sealing dies which are in conventional use today.

The foregoing is illustrative of the principles of this invention. Modifications and variations within the terms of the appended claims are included within the scope of the invention. By way of illustration, the precise configuration or pattern delineated by partitions 18 is not critical. Orthopedists may differ on the preferred configuration, but all variations are included in the invention.

I claim:

1. A method of making a liquid-filled insole of the character described, said method comprising the following steps:

a. forming a flexible, thermoplastic, dish-shaped bottom sheet in the outline of an insole, b. introducing a liquid into said dish-shaped bottom sheet, c. placing a second flexible, thermoplastic sheet in the outline of an insole upon said liquid-filled dish-shaped bottom sheet, d. applying pressure to said second sheet to displace any air between it and the liquid in the dish-shaped bottom sheet, e. heat-sealing the two sheets to each other along their peripheral edged to form a liquid-tight, liquid-filled envelope, and f. heat-sealing the two sheets to each other in an orthopedic pattern between said sealed peripheral edges, g. thereby forming a plurality of non-communicating, liquid-tight, liquid-filled compartments between the two sheets to provide a cushion effect.

2. A method in accordance with claim 1, wherein:

a. the two sheets are heat-sealed to each other in an orthopedic pattern which provides separate liquid-tight, liquid-filled compartments which cushion distinct anatomical parts of the human foot, b. separate compartments being formed to cushion the ball, heel, toes and arch of the foot.

* * * * *